US011376612B2

(12) United States Patent
Fan

(10) Patent No.: US 11,376,612 B2
(45) Date of Patent: Jul. 5, 2022

(54) SHOWER HEAD WITH SHOWER HOLDER

(71) Applicant: Fujian Onlytop Sanitaryware Co., Ltd., Zhangzhou (CN)

(72) Inventor: Kunjing Fan, Zhangzhou (CN)

(73) Assignee: Fujian Onlytop Sanitaryware Co., Ltd., Zhangzhou (CN)

( * ) Notice: Subject to any disclaimer, the term of this patent is extended or adjusted under 35 U.S.C. 154(b) by 0 days.

(21) Appl. No.: 17/464,725

(22) Filed: Sep. 2, 2021

(65) Prior Publication Data

US 2022/0143631 A1 May 12, 2022

(30) Foreign Application Priority Data

Nov. 11, 2020 (CN) ..... 202022601296.6

(51) Int. Cl.

| | |
|---|---|
| ***B05B 1/18*** | (2006.01) |
| ***B05B 1/16*** | (2006.01) |
| ***B05B 15/63*** | (2018.01) |
| ***B05B 12/00*** | (2018.01) |
| ***B05B 12/04*** | (2006.01) |
| ***B05B 15/62*** | (2018.01) |

(52) U.S. Cl.

CPC ..... *B05B 1/185* (2013.01); *B05B 1/1636* (2013.01); *B05B 1/1672* (2013.01); *B05B 12/002* (2013.01); *B05B 12/04* (2013.01); *B05B 15/63* (2018.02); *B05B 15/62* (2018.02)

(58) Field of Classification Search

CPC ..... B05B 1/1636; B05B 1/1672; B05B 1/18; B05B 1/185; B05B 12/002; B05B 12/04; B05B 15/60; B05B 15/62; B05B 15/63; E03C 1/0408; E03C 1/0409

See application file for complete search history.

(56) References Cited

U.S. PATENT DOCUMENTS

| | | | | |
|---|---|---|---|---|
| 8,919,379 | B2 * | 12/2014 | Zhou | E03C 1/0408 137/625.48 |
| 9,631,348 | B2 * | 4/2017 | Huang | B05B 1/1636 |
| 2006/0242759 | A1 * | 11/2006 | Tsai | E03C 1/06 4/605 |
| 2017/0173603 | A1 * | 6/2017 | Lin | B05B 1/1681 |
| 2018/0304279 | A1 * | 10/2018 | Zhu | B05B 1/1636 |
| 2020/0078801 | A1 * | 3/2020 | Lu | B05B 1/16 |
| 2021/0008584 | A1 | 1/2021 | Zhu et al. | |

* cited by examiner

*Primary Examiner* — Darren W Gorman

(74) *Attorney, Agent, or Firm* — Bayramoglu Law Offices LLC

(57) ABSTRACT

A shower head with a shower holder comprises a housing, a water outlet component, a switching handle and a water diversion component; the top of the housing is provide with a water inlet; a handle part extends outwards from one side of the housing, the tail end of the handle part is provided with a water outlet connector, and the shower holder and the switching handle are provided at two radial ends of the handle part, respectively; the water diversion component is provided inside the handle and comprises a water diversion device and a valve core, the water diversion device is provided with a water inlet channel, a first water outlet channel and a second water outlet channel, and the valve core is provided at the intersection area of the water inlet channel, the second water outlet channel and the first water outlet channel.

10 Claims, 8 Drawing Sheets

Prior Art

SHOWER HEAD WITH SHOWER HOLDER

CROSS REFERENCE TO RELATED APPLICATIONS

This application is based upon and claims priority to Chinese Patent Application No. 202022601296.6, filed on Nov. 11, 2020, the entire contents of which are incorporated herein by reference.

TECHNICAL FIELD

The present disclosure relates to a shower component, in particular to a shower head with a shower holder.

BACKGROUND

The conventional shower head and shower holder(socket for hand-held shower) are in a split design. For example, the shower holder is directly installed on the wall, and then the hand-held shower is placed on the shower holder. In this way, an additional shower holder needs to be installed on the wall, which increases the difficulty of installation.

To this end, the industry has developed a shower head with a holder device, referring to US20210008584A1. As shown in FIG. 1, a handle 1121' horizontally extends on one side of the housing 112' of the shower head, at least one water outlet connector 1122' is provided at the radial end of the handle 1121', the axial end of that handle 1121' is fixedly connected with a socket 7' for holding the hand-held shower 8', a water inlet 2' is provided at the top of the housing 112' near the handle 1121', and a knob 15' is provided on the end face of the handle 1121' facing the user. When the hand-held shower 8' is placed in the socket 7', the water outlet area of the hand-held shower 8' is vertically distributed with the water outlet area of the shower head 1'.

SUMMARY

The main purpose of the present disclosure is to provide a shower head with a shower holder, which is more convenient for users to switch waterways, and when a hand-held shower is inserted into the shower holder, the shower head can be closer to the water outlet area of the hand-held shower, so as to realize a shower head with a shower holder having a larger combined spray area.

In order to achieve the above purpose, the present disclosure discloses a shower head with a shower holder, comprising a shower head and a shower holder for holding a hand-held shower, wherein the shower head comprises a housing, a water outlet component, a switching handle and a water diversion component; the housing is provided with a water outlet area, the top of the housing is provided with a water inlet, and the water outlet component is provided in the water outlet area of the housing;

a handle part extends outwards from one side of the housing, the inner cavity of the handle part is hollow, a water outlet connector is provided at the axial end of the handle part, and a first mounting hole and a second mounting hole extend outwards at both radial ends of the handle part, respectively;

the water diversion component comprises a water diversion device and a valve core, the water diversion device comprises a water diversion valve seat, a first water diversion pipe and a second water diversion pipe, the water diversion valve seat is an axially penetrating hollow member, a first water diversion pipe and a second water diversion pipe are provided side by side along the radial direction on the side wall of the water diversion valve seat, and the joints of the first water diversion pipe and the second water diversion pipe with the side wall of the water diversion valve seat are provided with a water inlet end and a first water outlet end, respectively; the water diversion device is built in the inner cavity of the handle part, the first water diversion pipe and second water diversion pipe thereof face towards the inner end of the handle part, both ends of the water diversion valve seat are opposite to the first mounting hole and the second mounting hole, respectively, at the same time, the side wall of the water diversion valve seat is provided with a second water outlet end in the direction of the water outlet connector, and the water inlet end, the first water outlet end and the second water outlet end are circumferentially distributed;

the valve core is sequentially provided with a straight rod section and two spaced sealing sections along the axial direction thereof, a blocking part and a water passage are provided between the two sealing sections, the valve core is rotatably provided in the inner cavity of the water diversion valve seat, a water containing chamber is formed by the two sealing sections and the inner cavity of the water diversion valve seat, and the straight rod section of the water containing chamber extends outward from the first mounting hole;

the first water diversion pipe is communicated with the waterway of the water inlet, a water inlet channel is formed by the water inlet, the first water diversion pipe and the water inlet end; the second water diversion pipe is communicated with the waterway of the water outlet component, a first water outlet channel is formed by the first water outlet end and the second water diversion pipe; the second water outlet end of the water diversion valve seat is communicated with the waterway of the water outlet connector, a second water outlet channel is formed by the second water outlet end and the water outlet connector of the handle part, and the water containing chamber serves as a waterway pooling area of the water inlet channel, the first water outlet channel and the second water outlet channel;

the switching handle is fixedly connected with the straight rod section of the valve core, the blocking part of the valve core is driven to rotate circumferentially in the water containing chamber of the water diversion valve seat by rotating the switching handle at least for blocking the first water outlet end or the second water outlet, or attached to the inner wall of the water containing chamber, thereby realizing waterway switching of the water inlet channel, the first water outlet channel and the second water outlet channel;

a connecting base is also fixedly provided in the second mounting hole of the handle part, and the connecting base is connected with the shower holder.

Further, the water inlet is eccentrically provided at the top of the housing, the handle part is provided at one side of the housing adjacent to the water inlet, the shower holder is provided at the radial end side of the handle part, when the hand-held shower is placed in the shower holder, the water outlet area of the hand-held shower and the water outlet area of the water outlet component of the shower head are close to each other, so as to form mutually overlapped water outlet areas.

Further, the first mounting hole and the second mounting hole are respectively provided on a first extending section and a second extending section extending to both ends of the handle part in the radial direction.

Further, a positioning block is fixedly provided in the inner cavity of the first extension section, a first mounting hole is formed in the middle of the positioning block, an annular groove is formed between the positioning block and the first extension section, a switching handle is inserted into the annular groove, a positioning sound mechanism is provided between the positioning block and the switching handle, and when the switching handle is rotated to a designated position, the positioning sound mechanism will give a prompt sound.

With the above design, compared with the technical scheme of the shower head disclosed in the prior art (US20210008584A1), the present disclosure has the following beneficial technical effects.

1. The switch handle is provided at the radial extension section of the handle part of the shower head. As the radial extension section of the handle part is an open space, a switch handle with a larger contact area can be provided, so that the switch handle rotates circumferentially with the first mounting hole as the center of rotation, which is more convenient for users to switch waterways.

2. On the premise of the same pipe diameter of the handle part, the water diversion valve seat disclosed in the prior art can only be longitudinally provided in the inner cavity of the handle part. Due to the limitation of the pipe diameter of the handle part, the volume of the water containing chamber in the water diversion valve seat is limited. At the same time, since its positioning sound mechanism also needs to be provided in the inner cavity of the water diversion valve seat to further reduce the water containing space of the water containing chamber. In the present disclosure, the switching handle, the shower holder and the positioning sound mechanism are all provided on the extension section of the handle part. The inner cavity of the handle part has larger space for setting the water diversion valve seat, that is, the volume of the water containing chamber in the water diversion valve seat is larger, which can undertake larger flow, further expand the flow of the water inlet channel, the first water outlet channel and the second water outlet channel, and improve the shower effect.

3. The water outlet connector is provided at the axial end of the handle part, which is located at the low position of the shower head, which is convenient for water to flow from the water inlet(with high potential energy) to the water outlet connector(with low potential energy) through the water inlet channel and the second water outlet channel.

4. The shower holder is provided at the radial end of the handle part. When the hand-held shower is placed in the shower holder, the distance between the water outlet area of the hand-held shower and the water outlet area of the water outlet component of the shower head is the closest. When showering, the water outlet area of the shower head and the water outlet area of the hand-held shower are opened at the same time, which can form mutually overlapped water outlet areas, that is, the whole water outlet area of the water outlet device is larger, which can further increase the shower comfort and enhance the shower experience.

DETAILED DESCRIPTION OF THE EMBODIMENTS

Figure 1:
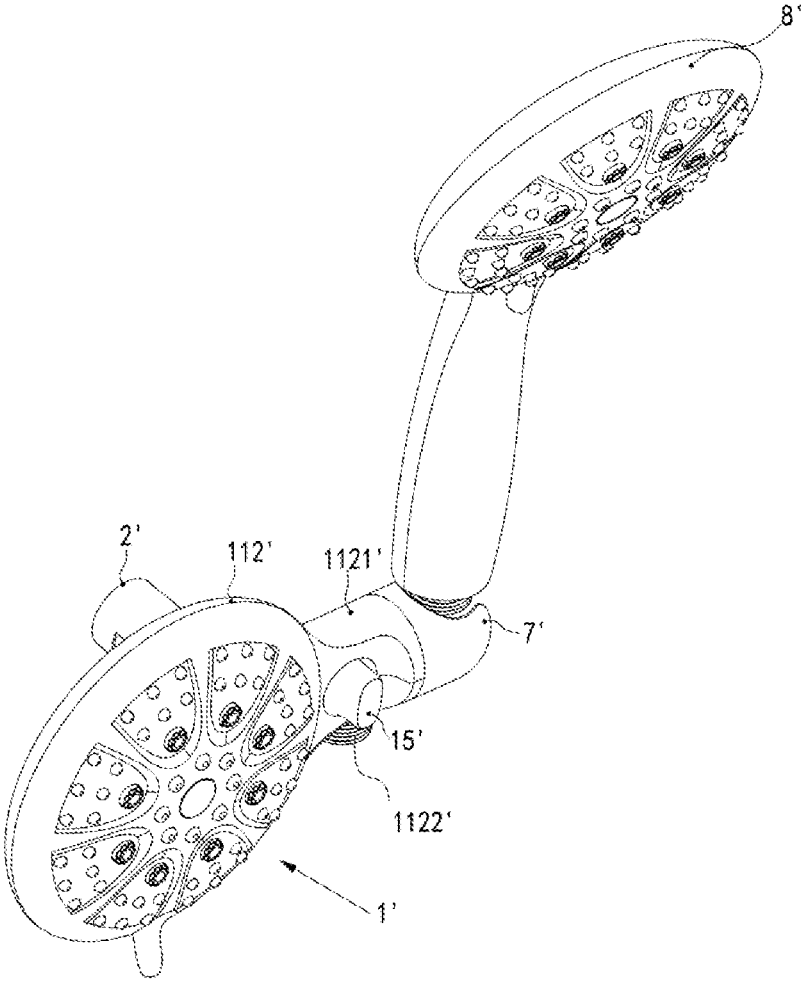
FIG. 1 is a combined view of a shower head with a shower holder and a hand-held shower disclosed in the prior art US20210008584A1.
Figure 2:
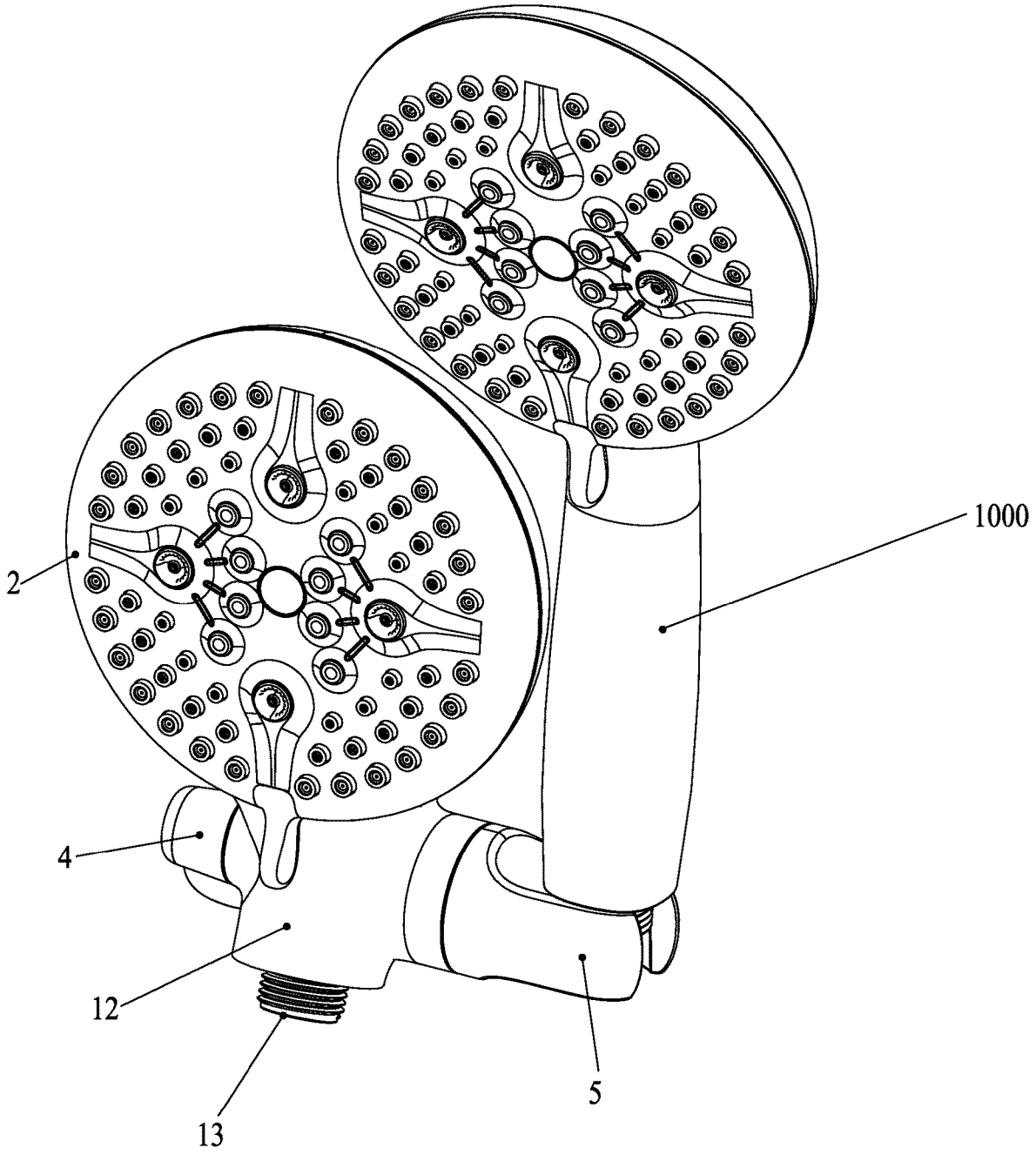
FIG. 2 is a combined view of a shower head with a shower holder and a hand-held shower according to the present disclosure.
Figure 3:
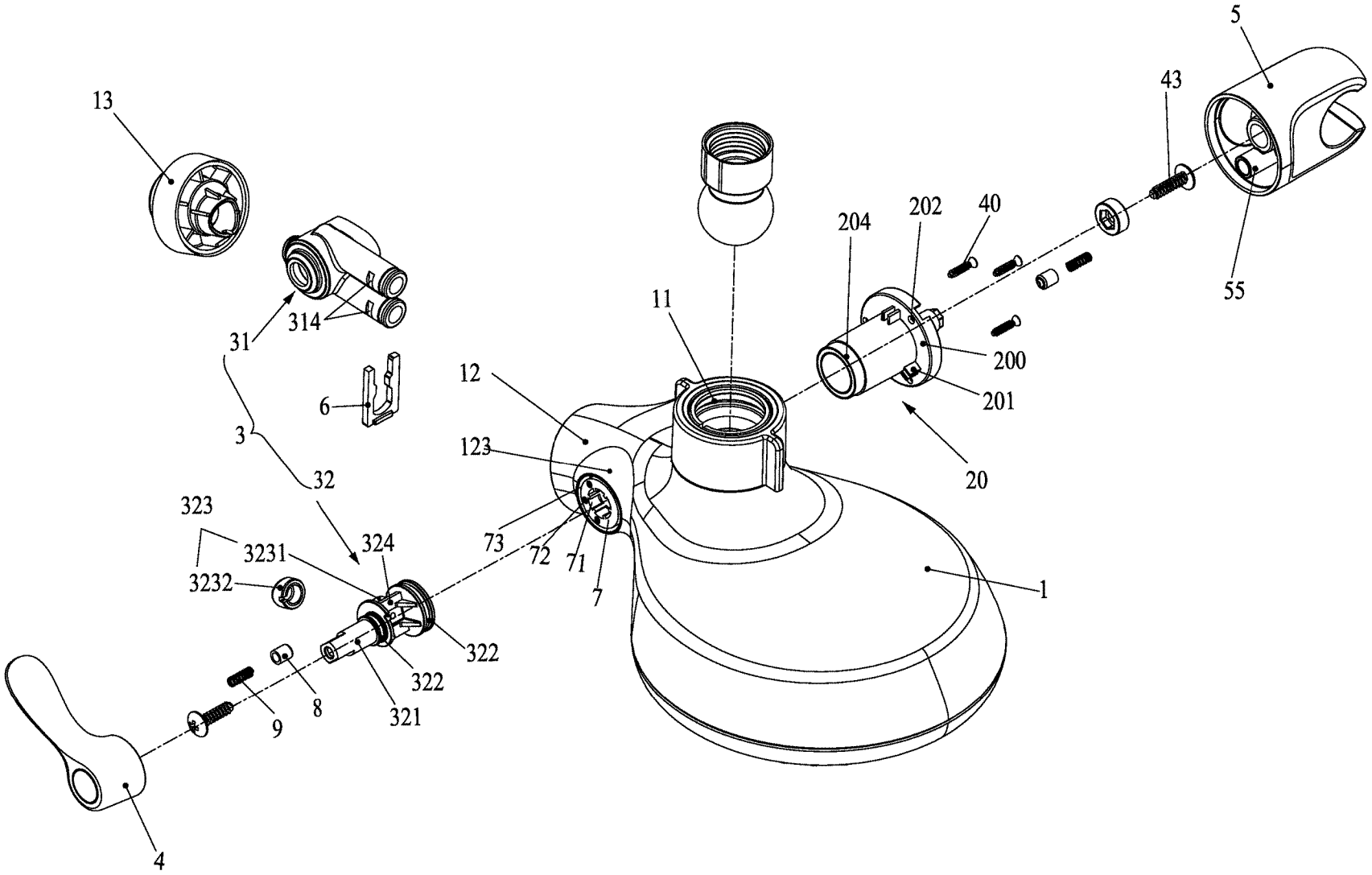
FIG. 3 is an exploded view of a shower head with a shower holder according to the present disclosure.
Figure 4:
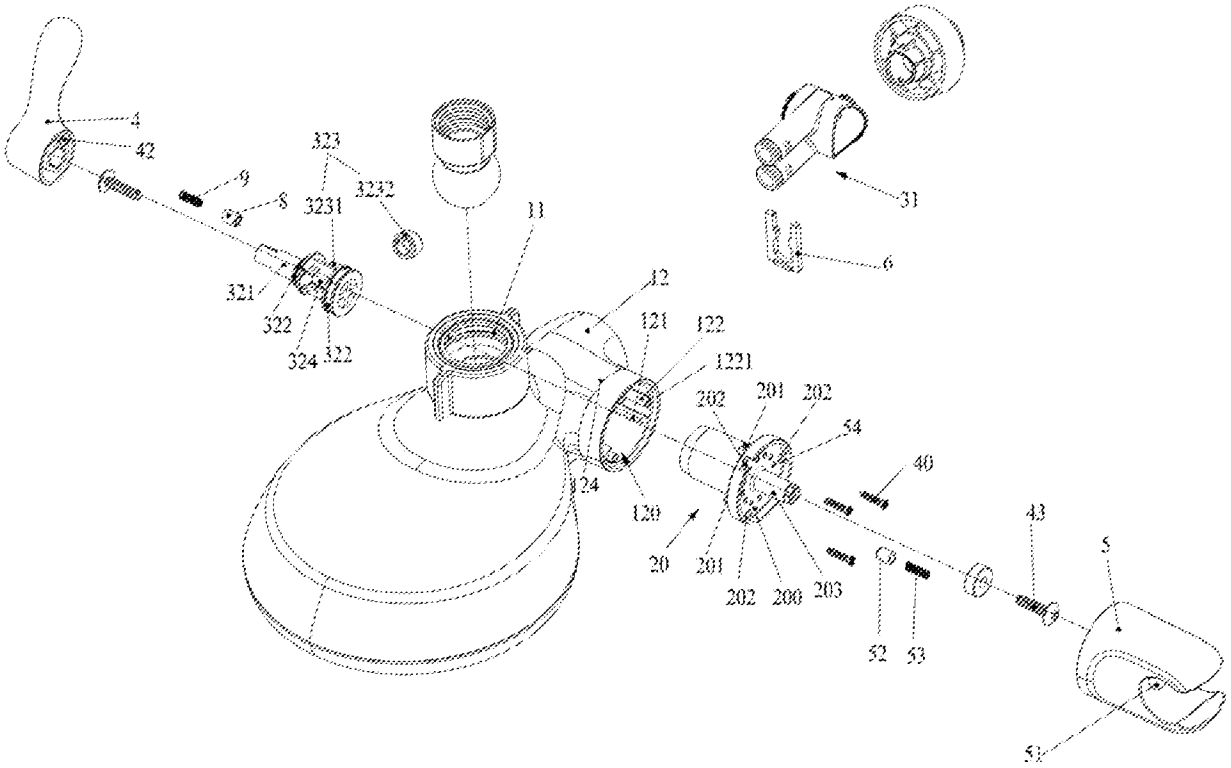
FIG. 4 is an exploded view of a shower head with a shower holder according to the present disclosure from another angle.

The present disclosure discloses a shower head with a shower holder. As shown in FIGS. 2 to 4, the shower head comprises a housing 1, a water outlet component 2, a switching handle 4 and a water diversion component 3.

The housing 1 is provided with a water outlet area. The water outlet component 2 is provided in the water outlet area of the housing 1. A water inlet 11 is provided at an eccentric position on the top of the housing 1, and a handle part 12 extends outwards on one side of the housing 1 adjacent to the water inlet 11. The inner cavity of the handle part 12 is hollow. A water outlet connector 13 is provided at the axial end of the handle part 12. A first extension section 123 and a second extension section 124 extend outwards at both radial ends of the handle part 12, respectively. A positioning block 7 is fixedly provided in the inner cavity of the first extension section 123. An annular groove 73 is provided between the positioning block 7 and the first extension section 123. A first mounting hole 71 is formed in the middle of the positioning block 7. The second extension section 124 is provided with a second mounting hole 120. A plurality of plug boards 121 and a plurality of screw posts 122 are circumferentially provided on the inner wall of the second mounting hole 120, and the plug boards 121 and the screw posts 122 are staggered.

Figure 6:
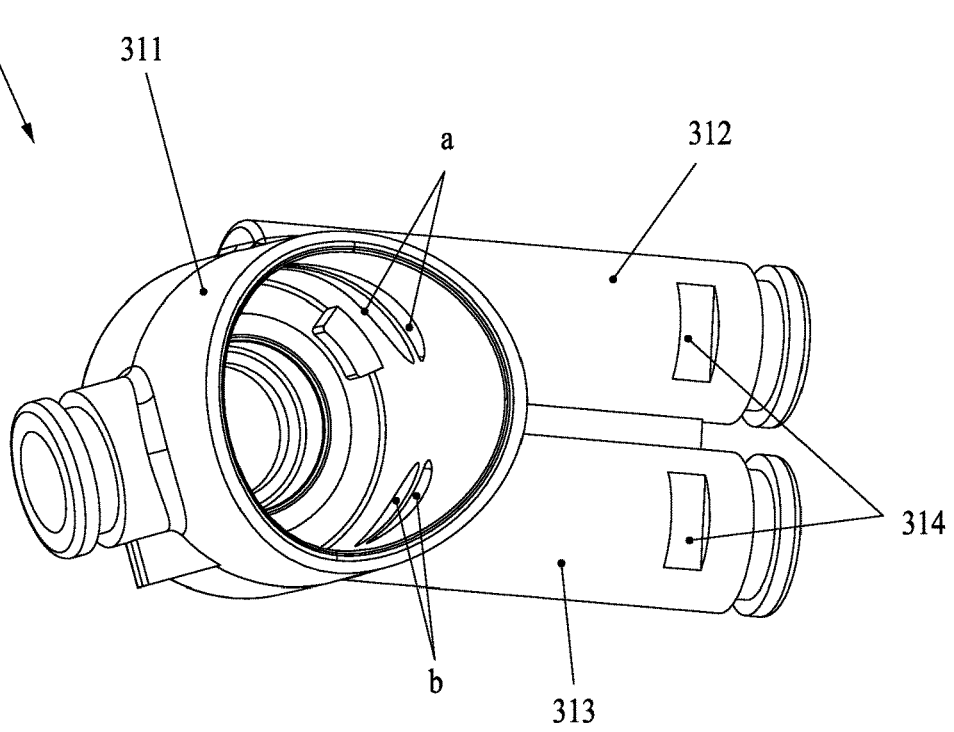
FIGS. 6 and 7 are structural diagrams of a water diversion device according to the present disclosure.
Figure 7:
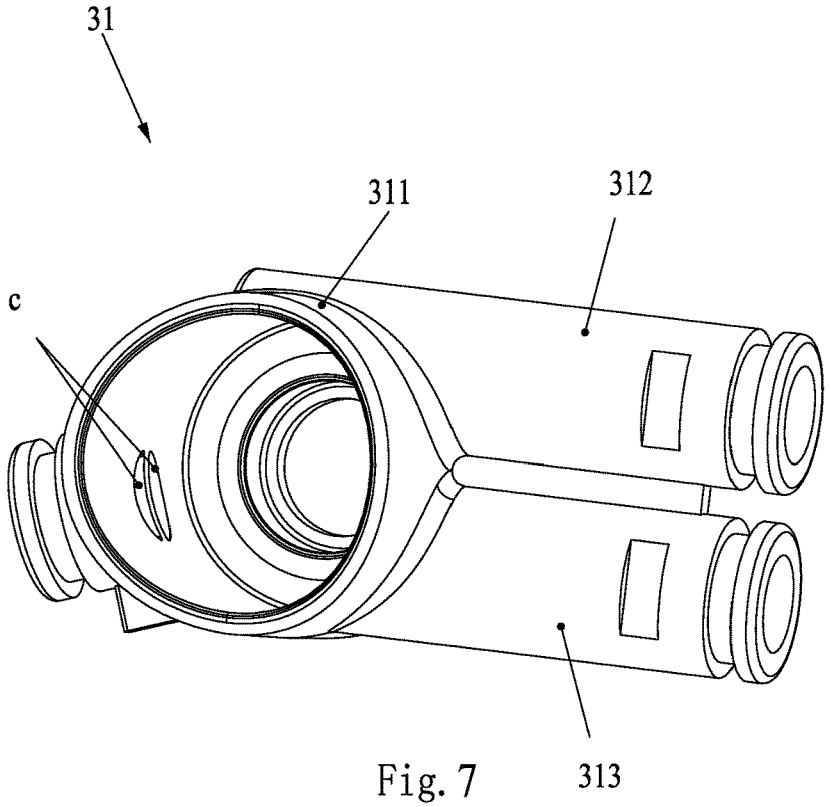
Figure 8:
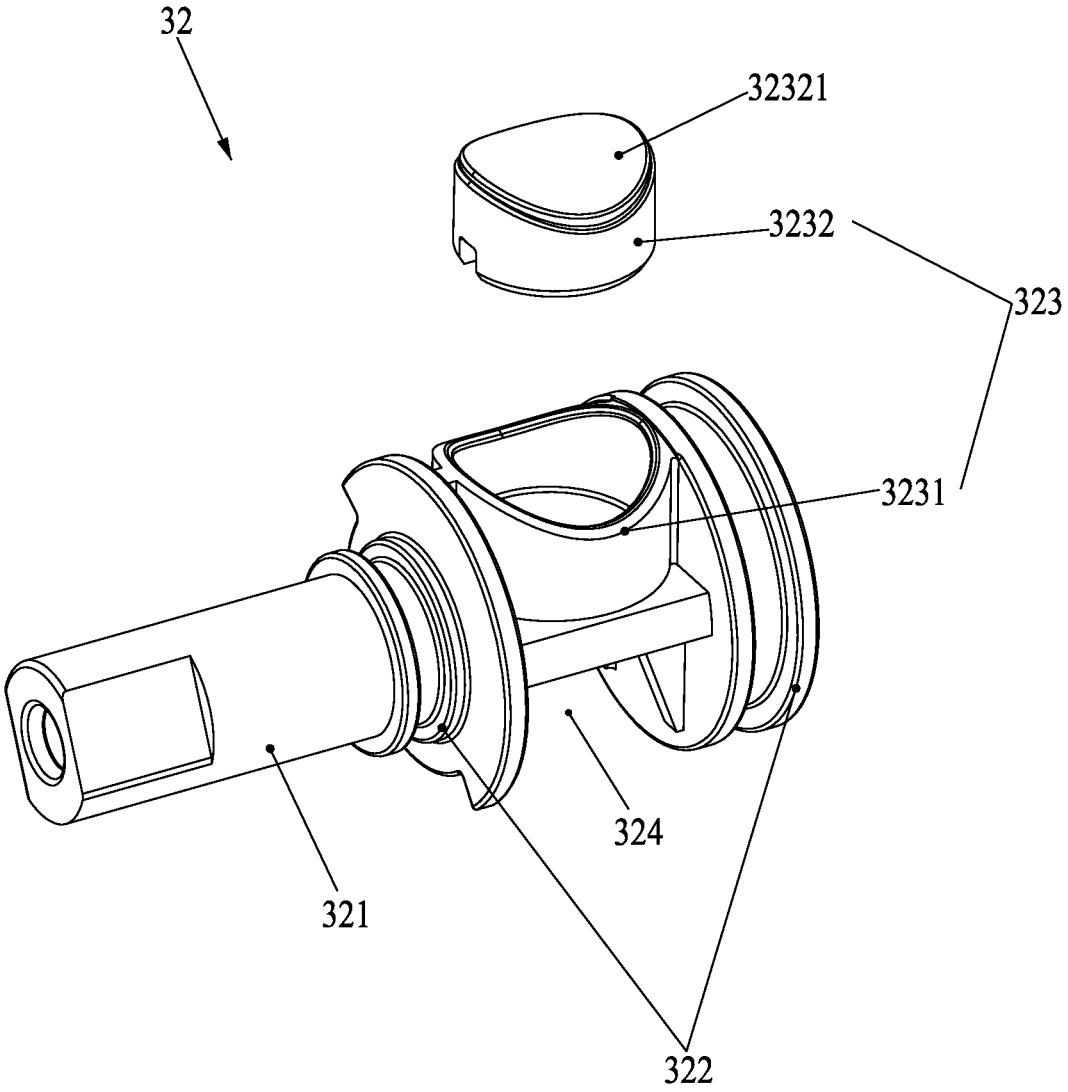
FIG. 8 is a structural diagram of a valve core according to the present disclosure.
Figure 9:
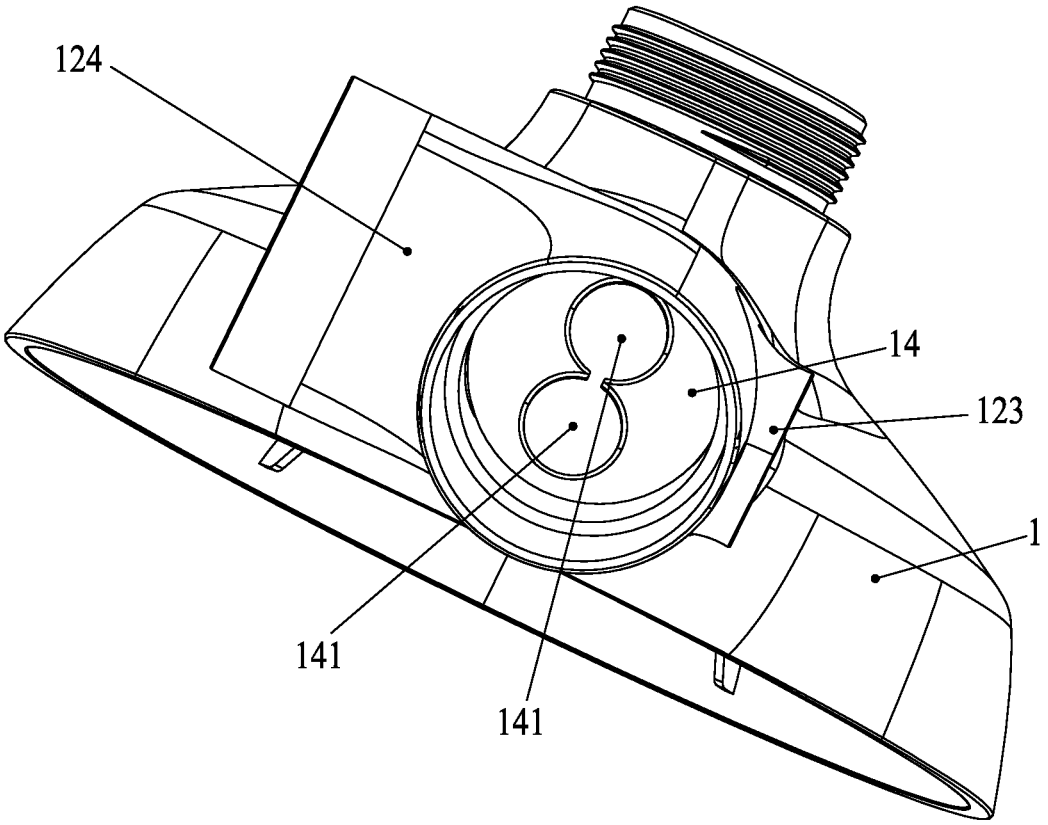
FIG. 9 is a schematic diagram of a rear structure of a housing according to the present disclosure.

As shown in FIG. 6 to FIG. 8, the water diversion component 3 comprises a water diversion device 31 and a valve core 32. The water diversion device 31 comprises a water diversion valve seat 311, a first water diversion pipe 312 and a second water diversion pipe 313. The water diversion valve seat 311 is an axially penetrating hollow member. A first water diversion pipe 312 and a second water diversion pipe 313 are provided side by side along the radial direction on the side wall of the water diversion valve seat 311. The joints of the first water diversion pipe 312 and the second water diversion pipe 313 with the side wall of the water diversion valve seat are provided with a water inlet end(a) and a first water outlet end(b), respectively. The water diversion device 31 is built in the inner cavity of the handle part 12. The first water diversion pipe 312 and second water diversion pipe 313 thereof face towards the inner end of the handle part 12. Both ends of the water diversion valve seat 311 are opposite to the first mounting hole 71 and the second mounting hole 120, respectively. At the same time, the side wall of the water diversion valve seat 311 is provided with a second water outlet end(c) in the direction of the water outlet connector 13. The water inlet end(a), the first water outlet end(b) and the second water outlet end(c) are circumferentially distributed. In order to better position the water diversion device 31 in the inner cavity of the handle part 12, as shown in FIG. 9, a partition wall 14 is provided inside the handle part 12 and on one side facing the water diversion device 31. Two positioning through holes 141 are provided on the partition wall 14. The two positioning through holes 141 are matched with the first water diversion pipe 312 and the second water diversion pipe 313, respectively. The first water diversion pipe 312 and the second water diversion pipe 313 are inserted into the two positioning through holes 141, respectively, so as to realize positioning. More preferably, a pair of bayonets 314 are provided on the side surfaces of the first water diversion pipe 312 and the second water diversion pipe 313, respectively. A U-shaped snap ring 6 is embedded in the bayonets 314 with the opening facing upwards. The U-shaped snap ring 6 is clamped on one end face of the partition wall 14 away from the water diversion device 31, thereby ensuring that the first water diversion pipe 312 and the second water diversion pipe 313 are relatively fixed with the handle part 12 in the axial direction.

Figure 5:
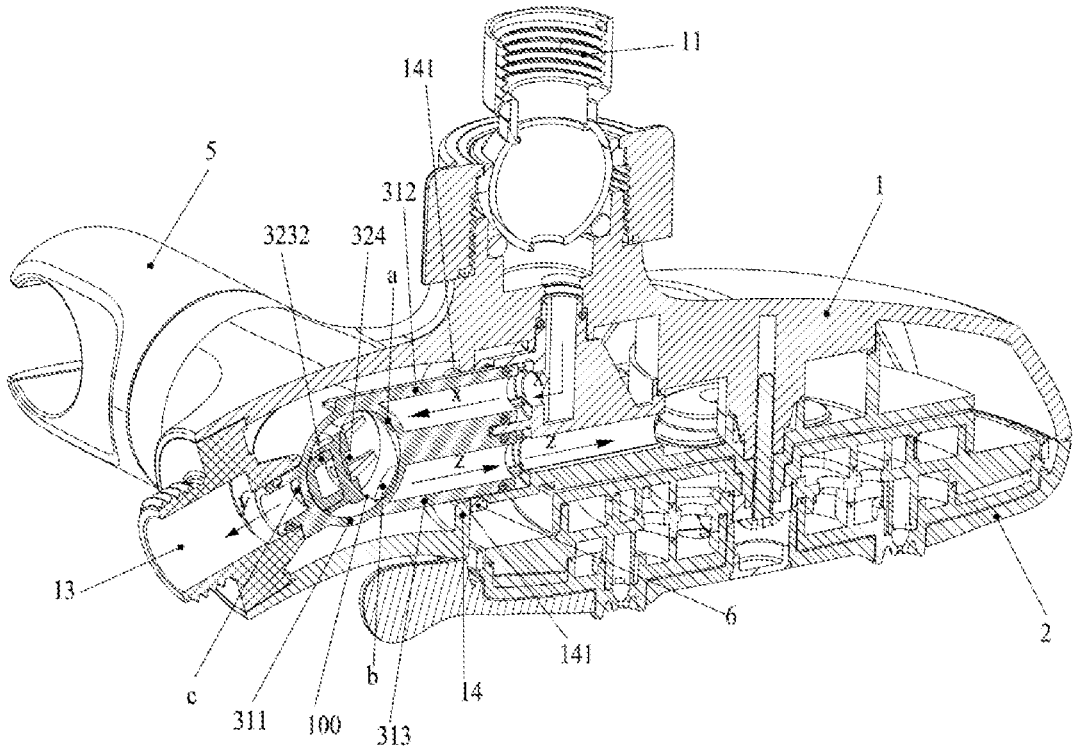
FIG. 5 is a longitudinal sectional view of a shower head with a shower holder according to the present disclosure.

As shown in FIG. 5, the first water diversion pipe 312 is communicated with the waterway of the water inlet 11. A water inlet channel(x) is formed by the water inlet 11, the first water diversion pipe 312 and the water inlet end a. The second water diversion pipe 313 is communicated with the waterway of the water outlet component 2. A first water outlet channel(z) is formed by the first water outlet end b and the second water diversion pipe 313. The second water outlet end c of the water diversion valve seat 311 is communicated with the waterway of the water outlet connector 13. A second water outlet channel(y) is formed by the second water outlet end c and the water outlet connector 13 of the handle part 12.

As shown in FIG. 8, the valve core 32 is sequentially provided with a straight rod section 321 and two spaced sealing sections 322 along the axial direction thereof. A blocking part 323 and a water passage 324 are provided between the two sealing sections 322. The blocking part 323 comprises a positioning cylinder 3231 and a rubber plug 3232 which are transversely provided. The rubber plug 3232 is sleeved in the positioning cylinder 3231. The outer end surface 32321 of the rubber plug 3232 protrudes from the positioning cylinder 3231. The valve core 32 is rotatably provided in the inner cavity of the water diversion valve seat 311. A water containing chamber 100 is formed by the two sealing sections 322 and the inner cavity of the water diversion valve seat 311. The water containing chamber 100 serves as a waterway pooling area of the water inlet channel (x), the first water outlet channel(z) and the second water outlet channel(y). The rubber plug 3232 is completely attached to the inner wall of the water diversion valve seat 311, which is used for blocking the first water outlet end(b) and the second water outlet end(c). The straight rod section 321 extends outward from the first mounting hole 71.

As shown in FIG. 3 and FIG. 4, the switching handle 4 is provided at the outer end of the first extending section 123, is rotatably inserted into the annular groove 73 provided between the positioning block 7 and the first extending section 123, and is fixedly connected with the straight rod section 321 of the valve core 32. The rubber plug 3232 of the valve core 31 is driven to rotate circumferentially in the water containing chamber 100 of the water diversion valve seat 311 by rotating the switching handle 4 for blocking the first water outlet end b or the second water outlet c, or attached to the inner wall of the water containing chamber 100, so that the water inlet channel(x) is communicated with the waterway of the first water outlet channel(z), or the water inlet channel(x) is communicated with the waterway of the second water outlet channel(y), or the water inlet channel(x) is communicated with the waterway of the first water outlet channel(z) and the second water outlet channel(y) simultaneously. More preferably, in order to better position the rotation angle of the switching handle 4, a positioning sound mechanism is provided between the positioning block 7 and the switching handle 4. The positioning sound mechanism comprises a positioning pin 8, a spring 9 and positioning blind holes 72. The switching handle 4 forms an accommodating cavity 42 for accommodating the spring 9 and the positioning pin 8. The outer end face of the positioning block 7 is provided with a plurality of positioning blind holes 72 along the circumferential direction. The three positioning blind holes 72 are opposite to the inner wall of the water containing chamber 100, the first water outlet end(b) and the second water outlet end(c), respectively. When the switching handle 4 is rotated, the positioning pin 8 collides with the inner wall of the positioning blind hole 72 under the action of the restoring force of the spring 9, thereby forming a prompt sound that the switching handle 4 is switched in place.

As shown in FIG. 4, a connecting base 20 is also fixedly provided in the second mounting hole 120 of the handle part 12. The connecting base 20 comprises a sleeve-shaped body. A positioning plate 200 extending outwards is formed on the top of the body. A plurality of slots 201 are provided on the outer side wall of the body or the bottom end face of the positioning plate 200 with respect to the plug board 121. A plurality of slots 201 fixing holes 202 are provided on the positioning plate 200 with respect to the positioning post. At the same time, an upwardly extending fixing post 203 is formed in the middle of the top end face of the positioning plate 200. When the connecting base 20 is built into the second mounting hole 120, the plug board 121 in the second mounting hole 120 is correspondingly inserted into each slot 201. At the same time, the first fastener 40 sequentially passes through the corresponding fixing hole 202 and the screw hole 1221 on the screw post 122 to fix the connecting base 20 in the second extension section 124. The shower holder 5 is provided with a fixing through hole 51. A second fastener 43 passes through the fixing through hole 51 and is screwed and locked to the fixing post 203, thereby fixing the shower holder 5 and the connecting base 20. More preferably, the body of the connecting base 20 forms a small-diameter end 204 at the end far away from the positioning plate 200. The small-diameter end 204 is used for being sleeved in the inner cavity of the water diversion valve seat 311, thereby further increasing the axial stability of the water diversion valve seat 311, and at the same time, further preventing the water flowing through the water containing chamber 100 from overflowing towards the shower holder 5.

More preferably, the shower holder 5 is rotatably provided on the fixing post 203, so that the hand-held shower 1000 placed on the shower holder 5 can generate different shower angles to meet the shower needs of users. A positioning sound mechanism is additionally provided between the shower holder 5 and the positioning plate 200. The positioning sound mechanism has the structure basically the same as that of the positioning sound mechanism formed by the switching handle 4, comprising a positioning pin 52, a spring 53 and a positioning blind hole 54. The shower holder 5 forms an accommodating cavity 55 for accommodating the spring 53 and the positioning pin 52. The outer end face of the positioning block 200 is provided with a plurality of positioning blind holes 54 along the circumferential direction. When the shower holder 5 is rotated, the positioning pin 52 collides with the inner wall of the positioning blind hole 54 under the action of the restoring force of the spring 52, thereby forming a prompt sound that the shower holder 5 is switched in place.

In the shower head with a shower holder manufactured by the above structure, the switching handle 4 and the shower holder 5 are respectively provided at the two ends of the radial extension section of the handle part 12, so that the inner cavity of the handle part 12 can provide a larger water containing space for the water diversion component 3, especially for the water diversion valve seat 31, and increase the overflow of the water inlet channel(x), the first water outlet channel(z) and the second water outlet channel(y). At the same time, a switching handle 4 with a larger contact area can also be provided, which is convenient for users to switch waterways. When the hand-held shower 1000 is inserted into the shower holder 5, the water outlet areas of the hand-held shower and the shower holder are adjacent. The switching handle 4 is switched to the water inlet channel(x) and is simultaneously communicated with the waterways of the first water outlet channel(z) and the second water outlet channel(y). The hand-held shower 1000 and the water outlet component 2 of the shower head simultaneously discharge water, which can overlap a larger water outlet area and improve the shower experience.

The above description merely relates to embodiments of the present disclosure, and is not intended to limit the design of the present disclosure. Any equivalent changes made according to key points of the design of the present disclosure will fall within the scope of protection of the present disclosure.

What is claimed is:

1. A shower head with a shower holder, comprising:

a housing, a water outlet component, a switching handle, and a water diversion component; wherein the shower holder is configured for holding a hand-held shower;

the housing is provided with a water outlet area, a top of the housing is provided with a water inlet, and the water outlet component is provided in the water outlet area of the housing;

a handle part extends outwards from one side of the housing, an inner cavity of the handle part is hollow, a water outlet connector is provided at a first end of the handle part in an axial direction of the handle part, and a first mounting hole and a second mounting hole extend outwards at a second end and a third end of the handle part in a radial direction of the handle part, respectively;

the water diversion component comprises a water diversion device and a valve core, the water diversion device comprises a water diversion valve seat, a first water diversion pipe, and a second water diversion pipe, the water diversion valve seat is a hollow member, the first water diversion pipe and the second water diversion pipe are provided side by side on a side wall of the water diversion valve seat along a radial direction of the water diversion valve seat, a joint of the first water diversion pipe and the side wall of the water diversion valve seat is provided with a water inlet end, and a joint of the second water diversion pipe and the side wall of the water diversion valve seat is provided with a first water outlet end; the water diversion device is located in the inner cavity of the handle part, the first water diversion pipe and the second water diversion pipe face towards an interior of the handle part, the water diversion valve seat has a first end and a second end opposite to each other in an axial direction of the water diversion valve seat, the first end of the water diversion valve seat is located adjacent to the first mounting hole, and the second end of the water diversion valve seat is located adjacent to the second mounting hole, the side wall of the water diversion valve seat is provided with a second water outlet end communicating with the water outlet connector, and the water inlet end, the first water outlet end, and the second water outlet end are circumferentially distributed;

the valve core is sequentially provided with a straight rod section and two spaced sealing sections along an axial direction of the valve core, a blocking part and a water passage are provided between the two spaced sealing sections, the valve core is rotatably provided in an inner cavity of the water diversion valve seat, a water containing chamber is formed by the two spaced sealing sections and the inner cavity of the water diversion valve seat, and the straight rod section of the valve core extends outward from the first mounting hole;

the first water diversion pipe is communicated with the water inlet, a water inlet channel is formed by the water inlet, the first water diversion pipe, and the water inlet end; the second water diversion pipe is communicated with the water outlet component, a first water outlet channel is formed by the first water outlet end and the second water diversion pipe; the second water outlet end of the water diversion valve seat is communicated with the water outlet connector, a second water outlet channel is formed by the second water outlet end and the water outlet connector of the handle part, and the water containing chamber serves as a waterway pooling area of the water inlet channel, the first water outlet channel and the second water outlet channel;

the switching handle is fixedly connected with the straight rod section of the valve core, the blocking part of the valve core is driven to rotate circumferentially in the water containing chamber of the water diversion valve seat by rotating the switching handle, so that the blocking part is positioned at the first water outlet end, the second water outlet end, or a position between the first water outlet end and the second water outlet end, when the blocking part is positioned at the first water outlet end, the water inlet channel is communicated with the second water outlet channel, when the blocking part is positioned at the second water outlet end, the water inlet channel is communicated with the first water outlet channel, and when the blocking part is positioned at the position between the first water outlet end and the second water outlet end, the water inlet channel is communicated with the first water outlet channel and the second water outlet channel simultaneously;

a connecting base is also fixedly provided in the second mounting hole of the handle part, and the connecting base is connected with the shower holder.

2. The shower head according to claim 1, wherein the water inlet is eccentrically provided at the top of the housing, the handle part is provided at one side of the housing adjacent to the water inlet, the shower holder is provided at the third end of the handle part, when the hand-held shower is placed in the shower holder, a water outlet area of the hand-held shower and the water outlet area of the housing of the shower head are mutually overlapped.

3. The shower head according to claim 1, wherein the blocking part comprises a positioning cylinder and a rubber plug transversely provided, the rubber plug is sleeved in the positioning cylinder, an outer end surface of the rubber plug protrudes from the positioning cylinder, and the outer end surface of the rubber plug is an arc surface matched with an inner wall of the water diversion valve seat.

4. The shower head according to claim 1, wherein a partition wall is provided inside the handle part and on one side facing the water diversion device, two positioning through holes are provided on the partition wall, the two positioning through holes are matched with the first water diversion pipe and the second water diversion pipe, respectively, and the first water diversion pipe and the second water diversion pipe pass through the two positioning through holes, respectively.

5. The shower head according to claim 4, wherein a pair of bayonets are provided on side surfaces of the first water diversion pipe and the second water diversion pipe, respectively, a U-shaped snap ring is embedded in the bayonets with an opening of the U-shaped snap ring facing upwards, and the U-shaped snap ring is clamped on one end face of the partition wall away from the water diversion device.

6. The shower head according to claim 1, wherein the first mounting hole is provided on a first extension section at the second end of the handle part, and the second mounting hole is provided on a second extension section at the third end of the handle part.

7. The shower head according to claim 6, wherein a positioning block is fixedly provided in an inner cavity of the first extension section, the first mounting hole is formed in a middle of the positioning block, an annular groove is formed between the positioning block and the first extension section, the switching handle is inserted into the annular groove, a positioning sound mechanism is provided between the positioning block and the switching handle, the positioning sound mechanism comprises a positioning pin, a spring, and a plurality of positioning blind holes, the switching handle forms an accommodating cavity for accommodating the spring and the positioning pin, an outer end face of the positioning block is provided with the plurality of positioning blind holes along a circumferential direction of the positioning block; and when the switching handle is rotated, the positioning pin collides with an inner wall of each of the plurality of positioning blind holes under an action of a restoring force of the spring, thereby forming a prompt sound that the switching handle is switched in place.

8. The shower head according to claim 6, wherein a plurality of plug boards and a plurality of screw posts are circumferentially provided on an inner wall of the second mounting hole on the second extension section, and the plug boards and the screw posts are staggered; the connecting base comprises a sleeve-shaped body, a positioning plate extending outwards is formed on a top of the sleeve-shaped body, slots are correspondingly provided on an outer side wall of the sleeve-shaped body or a bottom end face of the positioning plate with respect to the plug boards, fixing holes are correspondingly provided on the positioning plate with respect to the screw posts, at the same time, an upwardly extending fixing post is formed in a middle of a top end face of the positioning plate, the plug boards each are correspondingly inserted into the slots, the connecting base is fixed to the second extension section by first fasteners each correspondingly passing through the fixing holes and locked to the screw posts, the connecting base is fixed in the second extension section, the shower holder is provided with a fixing through hole, and a second fastener passes through the fixing through hole and is screwed and locked to the upwardly extending fixing post, thereby fixing the shower holder and the connecting base.

9. The shower head according to claim 8, wherein the shower holder is rotatably provided on the screw posts, a positioning sound mechanism is additionally provided between the shower holder and the positioning plate, the positioning sound mechanism comprises a positioning pin, a spring and a plurality of positioning blind holes, the shower holder forms an accommodating cavity for accommodating the spring and the positioning pin; and when the shower holder is rotated, the positioning pin collides with an inner wall of each of the positioning blind holes under an action of a restoring force of the spring, thereby forming a prompt sound that the shower holder is switched in place.

10. The shower head according to claim 8, wherein a body of the connecting base forms a small-diameter end at an end far away from the positioning plate, the small-diameter end is used for being sleeved in the inner cavity of the water diversion valve seat, thereby further increasing an axial stability of the water diversion valve seat, and at the same time, further restricting water in the water containing chamber of the water diversion valve seat from overflowing towards the shower holder.

* * * * *